US008430696B2

(12) United States Patent
Matsumoto et al.

(10) Patent No.: US 8,430,696 B2
(45) Date of Patent: Apr. 30, 2013

(54) CONNECTOR HAVING IMPROVED FITTING PROPERTIES

(75) Inventors: Mitsuhiro Matsumoto, Makinohara (JP); Hajime Kato, Makinohara (JP); Suminori Arima, Makinohara (JP); Shinji Ichikawa, Toyota (JP)

(73) Assignees: Yazaki Corporation, Tokyo (JP); Toyota Jidosha Kabushiki Kaisha, Aichi-ken (JP)

( * ) Notice: Subject to any disclaimer, the term of this patent is extended or adjusted under 35 U.S.C. 154(b) by 122 days.

(21) Appl. No.: 12/991,458

(22) PCT Filed: Aug. 21, 2009

(86) PCT No.: PCT/JP2009/065013

§ 371 (c)(1),
(2), (4) Date: Nov. 8, 2010

(87) PCT Pub. No.: WO2010/024362

PCT Pub. Date: Mar. 4, 2010

(65) Prior Publication Data

US 2011/0059659 A1 Mar. 10, 2011

(30) Foreign Application Priority Data

Aug. 26, 2008 (JP) ..... 2008-217015

(51) Int. Cl.
*H01R 13/40* (2006.01)

(52) U.S. Cl.
USPC ..... 439/733.1; 439/271; 439/587

(58) Field of Classification Search ..... 439/733.1, 439/271, 587
See application file for complete search history.

(56) References Cited

U.S. PATENT DOCUMENTS

| | | | | |
|---|---|---|---|---|
| 5,346,406 | A | 9/1994 | Hoffman et al. | |
| 7,530,843 | B1 * | 5/2009 | Tesfay et al. | 439/587 |
| 8,123,535 | B1 * | 2/2012 | Yeon | 439/101 |
| 2008/0113552 | A1 | 5/2008 | Casperson et al. | |
| 2011/0130035 | A1 * | 6/2011 | Ebihara | 439/587 |

FOREIGN PATENT DOCUMENTS

| | | | |
|---|---|---|---|
| GB | 2339481 | A | 1/2000 |
| JP | 61-91885 | A | 5/1986 |
| JP | 3041443 | U | 7/1997 |

OTHER PUBLICATIONS

International Search Report for PCT/JP2009/065013, dated Oct. 27, 2009.
Communication, dated Aug. 30, 2012, issued by the European Patent Office in counterpart European Application No. 09810012.6.

* cited by examiner

*Primary Examiner* — Hae Moon Hyeon
(74) *Attorney, Agent, or Firm* — Sughrue Mion, PLLC

(57) ABSTRACT

A connector includes: a terminal fitting which includes a wire connecting portion and an electric contact portion disposed coaxially with the wire connecting portion; a connector housing for fitting to a mating connector; a rear holder which is fitted at an end portion of the connector housing; a terminal accommodating chamber which is provided in the connector housing. The terminal accommodating chamber includes a first accommodating portion for accommodating the wire connecting portion, a second accommodating portion which is continuous with the first accommodating portion to accommodate the electric contact portion, and a stepped surface formed between the first and second accommodating portions. The connector also includes a flange portion which projects from an outer peripheral surface of the wire connecting portion so as to contact the stepped surface, and a sleeve member provided between the flange portion and the rear holder.

4 Claims, 3 Drawing Sheets

CONNECTOR HAVING IMPROVED FITTING PROPERTIES

JOINT RESEARCH AGREEMENT

The presently claimed invention was made by or on behalf of the below listed parties to a joint research agreement. The joint research agreement was in effect on or before the date the claimed invention was made and the claimed invention was made as a result of activities undertaken within the scope of the joint research agreement. The parties to the joint research agreement are Yazaki Corporation and Toyota Jidosha Kabushiki Kaisha.

TECHNICAL FIELD

The present invention relates to a connector for constituting a part of a wire harness which is routed in an automobile or the like.

BACKGROUND ART

Various electronic devices are mounted in an automobile as a movable object. The automobile has wire harnesses routed to transmit electric power, control signals, and the like to the electronic devices. The wire harness has a plurality of electric wires 100 (shown in FIG. 4) and a connector 101 (shown in FIG. 4, for example). The electric wire 100 is a so-called covered electric wire having an electrically conductive core wire and an electrically insulated covering portion for covering the core wire, as shown in FIG. 4.

The connector 101 illustrated in FIG. 4 has a terminal fitting 102, a connector housing 103, a rear holder 104, and a rear packing 105. The terminal fitting 102 is formed of an electrically conductive metal and is formed into a cylindrical shape whose outside diameter changes in steps. The terminal fitting 102 integrally has a cylindrical wire connecting portion 106 to which the core wire of the aforementioned electric wire 100 is connected, as well as a cylindrical electrical contact portion 107 which is disposed coaxially with this wire connecting portion 106 and is electrically connected to a terminal fitting of a mating connector.

As the core wire of the electric wire 100 is inserted into the interior of the wire connecting portion 106 and is plastically deformed such that the inside and outside diameters of the wire connecting portion 106 are reduced, the electric wire 100 is fitted with its core wire crimped. The electric contact portion 107 is elastically deformable such that its inside and outside diameters are freely enlarged and reduced. As the terminal fitting of the mating connector is inserted into the interior of the electric contact portion 107, the electric contact portion 107 is electrically connected to the terminal fitting of the mating connector.

The connector housing 103 is formed of an electrically insulated synthetic resin and is formed into a box shape. A terminal accommodating chamber 108 for accommodating the aforementioned terminal fitting 102 is provided in the connector housing 103. A retaining projection 109, which projects from an inner surface of that terminal accommodating chamber 108 so as to retain an outer surface of the aforementioned terminal fitting 102, is provided in the terminal accommodating chamber 108. As the retaining projection 109 retains an outer peripheral surface of the terminal fitting 102, the connector housing 103 accommodates that terminal fitting 102 inside the terminal accommodating chamber 108. In addition, the connector housing 103 is fitted to a connector housing of the mating connector.

The rear holder 104 is formed of an electrically insulated synthetic resin and is formed into a cylindrical shape. The rear holder 104 is fitted at an end portion, on a side away from the connector housing of the mating connector, of the connector housing 103. A through hole 110 for allowing the electric wire 100 fitted to the terminal fitting 102 to be passed therethrough is provided in the rear holder 104.

The rear packing 105 is formed of an elastically deformable synthetic resin such as an elastomer. The rear packing 105 is formed into an annular shape. The rear packing 105 with the aforementioned electric wire 100 passed therethrough is inserted into the aforementioned terminal accommodating chamber 108. When the rear packing 105 with the electric wire 100 passed therethrough is inserted into the terminal accommodating chamber 108, the rear packing 105 undergoes elastic deformation and keeps watertight the gap between the outer peripheral surface of the electric wire 100 and the inner surface of the terminal accommodating chamber 108.

In addition, in the above-described connector 101, a shrinkable tube 111 is closely fitted over outer peripheries of the wire connecting portion 106 of the aforementioned terminal fitting 102 and the terminal of the electric wire 100, thereby preventing ingress of a liquid such as water into the core wire of the electric wire 100.

Since the above-described connector 101 is provided with the retaining projection 109 to prevent the terminal fitting 102 from coming off the interior of the terminal accommodating chamber 108, in the event that the retention of that retaining projection 109 is canceled, the terminal fitting 102 easily moves inside the terminal accommodating chamber 108, so that that terminal fitting 102 becomes difficult to be connected to the terminal fitting of the mating connector. Furthermore, with the above-described connector 101, since the shrinkable tube 111 covers the outer sides of the wire connecting portion 106 of the terminal fitting 102 and the terminal of the electric wire 100, the time and trouble involved in the assembly increase, so that the manhour required for the assembly has tended to increase.

SUMMARY OF INVENTION

Accordingly, an object of the invention is to provide a connector which is capable of preventing the terminal fitting from easily moving inside the terminal accommodating chamber even if the retaining projection is not provided.

To overcome the above-described problems and attain the above object, in accordance with a first aspect of the invention there is provided a connector including: a terminal fitting which includes a wire connecting portion connected to an electric wire and an electric contact portion disposed coaxially with the wire connecting portion; a connector housing which includes a fitting portion for fitting to a mating connector; a rear holder which is fitted at an end portion of the connector housing on an opposite side of the fitting portion; a terminal accommodating chamber which is provided in the connector housing, and which includes: a first accommodating portion for accommodating the wire connecting portion; a second accommodating portion which is continuous with the first accommodating portion to accommodate the electric contact portion and which is smaller in diameter than the first accommodating portion; and a stepped surface formed between the first and second accommodating portions; a flange portion which projects from an outer peripheral surface of the wire connecting portion so as to contact the stepped surface; and a sleeve member provided between the flange portion and the rear holder so as to be accommodated in the first accommodating portion.

In accordance with a second aspect of the invention, the connector further includes: a first packing provided between the sleeve member and the rear holder to keep watertight a gap between an outer peripheral surface of the electric wire and an inner surface of the first accommodating portion; and a second packing attached to an outer peripheral surface of the flange portion to keep watertight a gap between the outer peripheral surface of the flange portion and the inner surface of the first accommodating portion.

In accordance with a third aspect of the invention, the flange portion includes a recessed groove to accommodate the second packing.

In accordance with a fourth aspect of the invention, the sleeve member is formed into a cylindrical shape which is C-shaped in cross section.

In accordance with a fifth aspect of the invention, a longitudinal length of the first accommodating portion is the same as sum of the flange portion, the sleeve member and the first packing so that there is no gap between the stepped surface and the rear holder with respect to an inserting direction of the terminal fitting.

In accordance with the connector according to the aspects of the invention, the flange portion of the wire connecting portion of the terminal fitting is capable of abutting against the stepped surface of the terminal accommodating chamber, and the sleeve member is provided between the flange portion and the rear holder. For this reason, the flange portion, i.e., the terminal fitting, is prevented from coming off from between the stepped surface and the sleeve member.

In accordance with the connector according to the aspects of the invention, the first packing for keeping watertight the gap between the outer peripheral surface of the electric wire and the inner surface of the terminal accommodating chamber is provided between the sleeve member and the rear holder, and the second packing keeping watertight the gap between the outer peripheral surface of the flange portion of the terminal fitting is provided on the outer peripheral surface of the flange portion of the terminal fitting. For this reason, it is possible to prevent ingress of a liquid such as water into the core wire from the terminal end of the electric wire without covering the terminal end of the electric wire with a shrinkable tube.

As described above, according to the aspects of the invention, the flange portion, i.e., the terminal fitting, is prevented from coming off from between the stepped surface and the sleeve member. Accordingly, it is possible to prevent the terminal fitting from easily moving inside the terminal accommodating chamber without providing a retaining projection for retaining the terminal fitting.

In addition, according to the aspects of the invention, it is possible to prevent ingress of a liquid such as water into the core wire from the terminal end of the electric wire without covering the terminal end of the electric wire with a shrinkable tube. Therefore, it is possible to prevent an increase in the time and trouble involved in the assembly and prevent an increase in the manhour required for the assembly.

DESCRIPTION OF EMBODIMENTS

Figure 1:
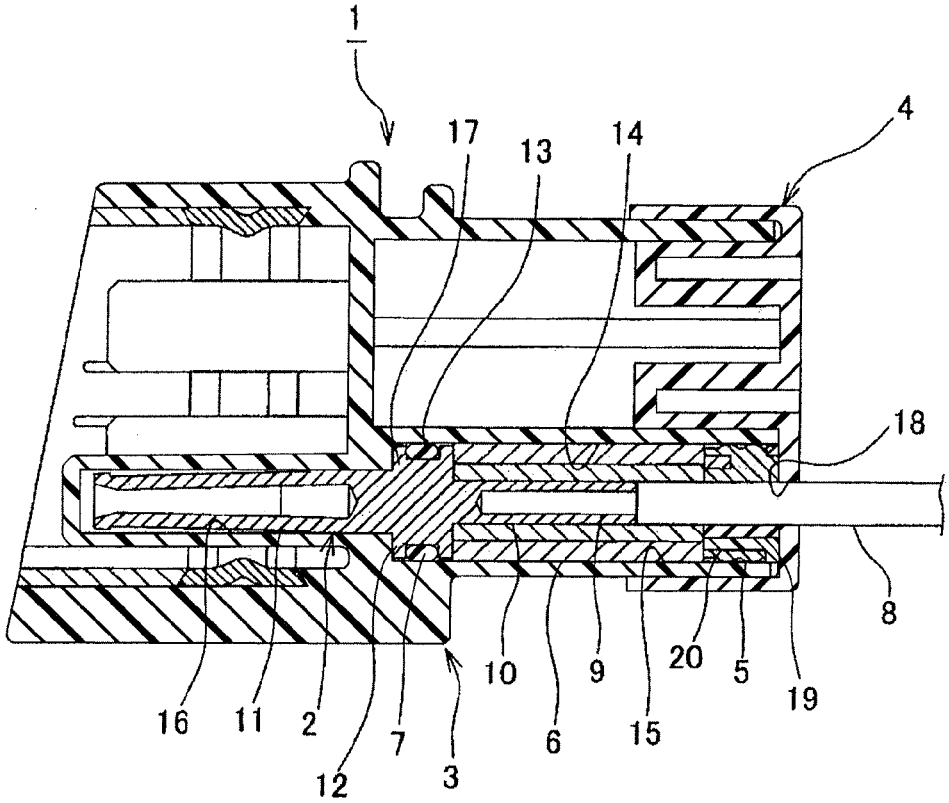
FIG. 1 is a cross-sectional view of a connector in accordance with an embodiment of the invention.
Figure 2:
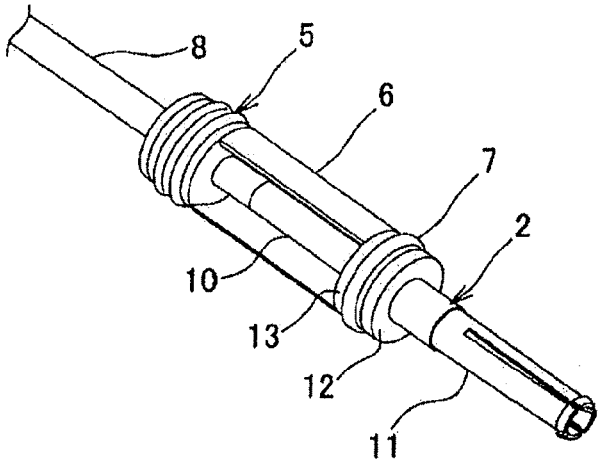
FIG. 2 is a perspective view illustrating such as a terminal fitting of the connector shown in FIG. 1.
Figure 3:
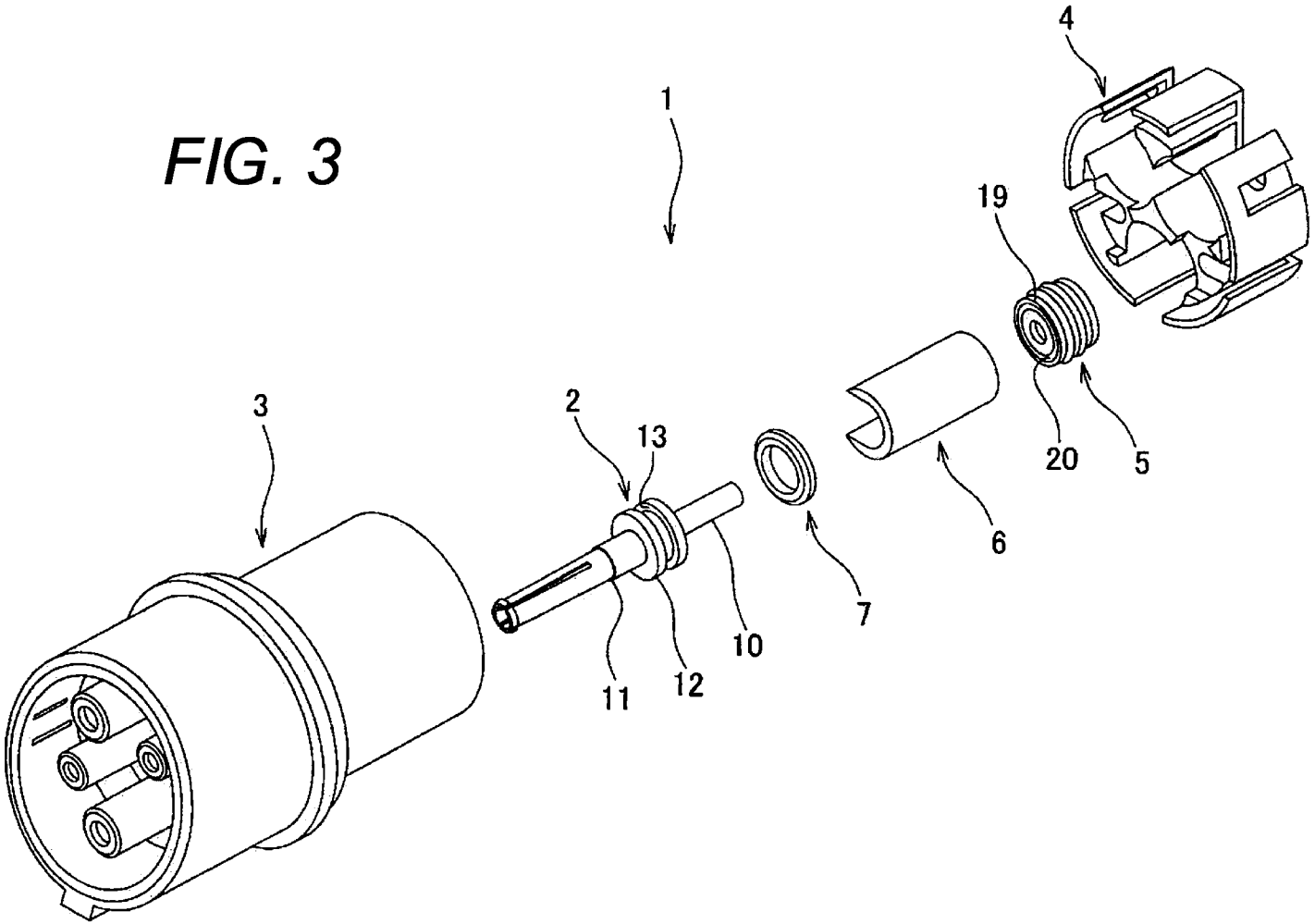
FIG. 3 is an exploded perspective view of the connector shown in FIG. 1.
Figure 4:
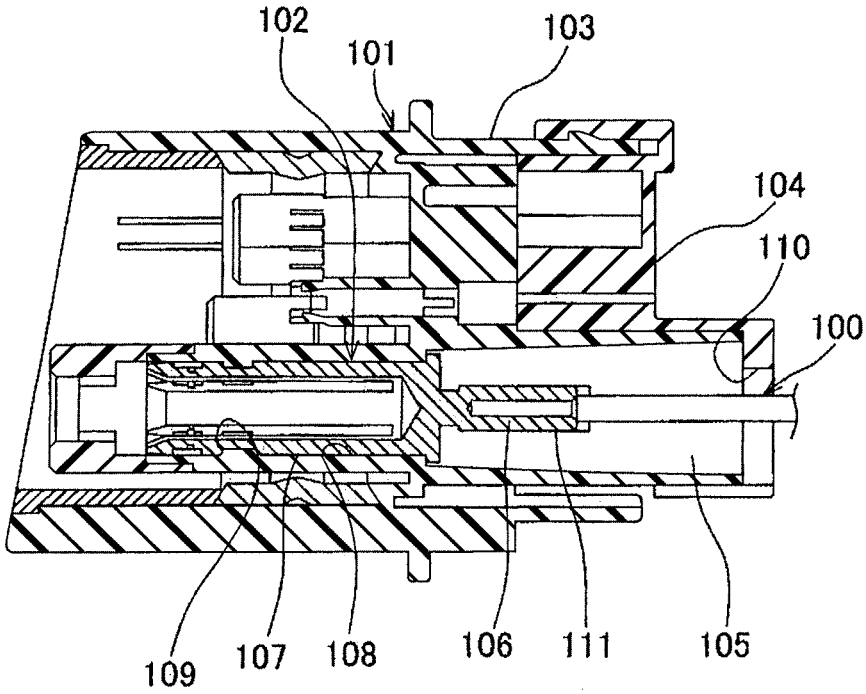
FIG. 4 PRIOR ART
FIG. 4 is a cross-sectional view of a related-art connector.

Referring to FIGS. 1 to 3, a description will be given of the connector in accordance with an embodiment of the invention.

A connector 1 is to be fitted to a mating connector (not shown). The mating connector has a connector housing formed of an electrically insulated synthetic resin and a terminal fitting accommodated in the connector housing.

As shown in FIGS. 1 and 3, the connector 1 has a terminal fitting 2, a connector housing 3 formed of an electrically insulated synthetic resin, a rear holder 4, a rear packing 5 as a first packing, a sleeve member 6, and a center packing 7 as a second packing.

The terminal fitting 2 is formed of an electrically conductive metal and is formed into a cylindrical shape whose outside diameter changes in steps. As shown in FIGS. 2 and 3, the terminal fitting 2 integrally has a cylindrical wire connecting portion 10 to which a core wire 9 of an electric wire 8 is connected, as well as a cylindrical electrical contact portion 11 which is disposed coaxially with the wire connecting portion 10 and is electrically connected to a terminal fitting of the mating connector.

As the core wire 9 of the electric wire 8 is inserted into the interior of the wire connecting portion 10 and is plastically deformed such that the inside and outside diameters of the wire connecting portion 10 are reduced, the electric wire 8 is fitted with its core wire 9 crimped. The electric contact portion 11 is elastically deformable such that its inside and outside diameters are freely enlarged and reduced. As the terminal fitting of the mating connector is inserted into the interior of the electric contact portion 11, the electric contact portion 11 is electrically connected to the terminal fitting of the mating connector.

A flange portion 12 is provided on the entire circumference of the wire connecting portion 10. The flange portion 12 is provided at an end of the wire connecting portion 10 close to the electric contact portion 11. The flange portion 12 projects from an outer peripheral surface of the wire connecting portion 10 and is disposed concentrically with the wire connecting portion 10. In addition, a recessed groove 13 is provided on the outer peripheral surface of the flange portion 12 over the entire circumference thereof.

The connector housing 3 is formed of an electrically insulated synthetic resin and is formed into a box shape, as shown in FIG. 3. A terminal accommodating chamber 14 for accommodating the aforementioned terminal fitting 2 is provided in the connector housing 3, as shown in FIG. 1. The terminal accommodating chamber 14 is a linearly extending space. The terminal accommodating chamber 14 includes a connecting portion accommodating portion (a first accommodating portion) 15; a contact portion accommodating portion (a second accommodating portion) 16 which is continuous with the connecting portion accommodating portion 15 and is coaxial with the connecting portion accommodating portion 15; and a stepped surface 17 provided between the connecting portion accommodating portion 15 and the contact portion accommodating portion 16.

The connecting portion accommodating portion 15 is formed into a circular shape in terms of its cross-sectional shape. The connecting portion accommodating portion 15 accommodates the wire connecting portion 10 of the terminal fitting 2. The contact portion accommodating portion 16 is formed into a circular shape in terms of its cross-sectional shape. The inside diameter of the contact portion accommodating portion 16 is formed to be smaller than the inside diameter of the connecting portion accommodating portion 15. The contact portion accommodating portion 16 accommodates the electric contact portion 11 of the terminal fitting 2. The stepped surface 17 opposes the flange portion 12 of the terminal fitting 2 along the longitudinal direction of the terminal accommodating chamber 14, i.e., the terminal fitting 2. As the stepped surface 17 opposes the flange portion 12, the stepped surface 17 is capable of coming into contact with that flange portion 12.

A connector housing of the unillustrated mating connector is fitted to an end portion, located on the left side of FIG. 1, of the connector housing 3 having the above-described construction.

The rear holder 4 is formed of an electrically insulated synthetic resin and is formed into a cylindrical shape. The rear holder 4 is fitted at an end portion, on an opposite side from the connector housing of the mating connector, of the connector housing 3. A through hole 18 for allowing the electric wire 8 fitted to the terminal fitting 2 to be passed therethrough is provided in the rear holder 4.

The rear packing 5 has a packing body 19 which is formed of an elastically deformable synthetic resin such as an elastomer, as well as an embedding member 20. The packing body 19 is formed into an annular shape. The embedding member 20 is formed of a synthetic resin which is hardly elastically deformed and is harder than the packing body 19. The rear packing 5 with the aforementioned electric wire 8 passed therethrough is inserted into the connecting portion accommodating portion 15 of the terminal accommodating chamber 14. When the rear packing 5 with the electric wire 8 passed therethrough is inserted into the connecting portion accommodating portion 15 of the terminal accommodating chamber 14, the rear packing 5 undergoes elastic deformation and keeps watertight the gap between the outer peripheral surface of the electric wire 8 and the inner surface of the connecting portion accommodating portion 15 of the terminal accommodating chamber 14.

The sleeve member 6 is formed into a cylindrical shape which is C-shaped in cross section. The sleeve member 6 with the wire connecting portion 10 passed therethrough is accommodated in the connecting portion accommodating portion 15 of the terminal accommodating chamber 14 in a state in which the sleeve member 6 with the wire connecting portion 10 passed therethrough is disposed between the flange portion 12 and the rear packing 5. Namely, the sleeve member 6 is disposed between the rear holder 4 and the flange portion 12 with the rear packing disposed between the sleeve member 6 and the rear holder 4. As shown in FIG. 1, a longitudinal length of the connection portion accommodating portion 15 is substantially the same as sum of the flange portion 12, the sleeve member 6 and the rear packing 5. Accordingly, there is no gap between the stepped surface 17 and the rear holder 4 with respect to an inserting direction of the terminal fitting 2 to prevent the terminal fitting 2 from moving with respect to the inserting direction.

The center packing 7 is formed of an elastically deformable synthetic resin such as an elastomer. The center packing 7 is formed into an annular shape. The center packing 7 with the flange portion 12 passed therethrough is accommodated in the recessed groove 13 of the flange portion 12. The center packing 7 is fitted in the recessed groove 13, i.e., the outer peripheral surface of the flange portion 12, and is elastically deformed by coming into contact with the outer peripheral surface of this flange portion 12 and the inner surface of the connecting portion accommodating portion 15 of the terminal accommodating chamber 14. The center packing 7 keeps watertight the gap between the outer peripheral surface of the flange portion 12 and the inner surface of the connecting portion accommodating portion 15 of the terminal accommodating chamber 14.

The connector 1 having the above-described construction is assembled as follows. First, the center packing 7 is fitted to the terminal fitting 2, the core wire 9 exposed at a terminal end of the electric wire 8 is inserted into the interior of the wire connecting portion 10 of the terminal fitting 2, and the wire connecting portion 10 is crimped to attach the electric wire 8 to the terminal fitting 2. Then, the electric wire 8 is inserted into the sleeve member 6, the sleeve member 6 is fitted to the terminal fitting 2, and the rear packing 5 is fitted. Subsequently, the terminal fitting 2 is inserted into the terminal accommodating chamber 14 of the connector housing 3, and the rear packing 5 is press fitted into the terminal accommodating chamber 14. Then, the rear holder 4 is fitted to the connector housing 3, thereby obtaining the above-described connector 1. The connector 1 thus assembled is fitted to a mating connector so as to constitute a wire harness which is routed in an automobile.

According to the embodiment, the flange portion 12 of the wire connecting portion 10 of the terminal fitting 2 is capable of abutting against the stepped surface 17 of the terminal accommodating chamber 14, and the sleeve member 6 is provided between the flange portion 12 and the rear holder 4. For this reason, the flange portion 12, i.e., the terminal fitting 2, is prevented from coming off from between the stepped surface 17 and the sleeve member 6. Accordingly, it is possible to prevent the terminal fitting 2 from easily moving inside the terminal accommodating chamber 14 without providing a retaining projection for retaining the terminal fitting 2.

In addition, the rear packing 5 for keeping watertight the gap between the outer peripheral surface of the electric wire 8 and the inner surface of the terminal accommodating chamber 14 is provided between the sleeve member 6 and the rear holder 4, and the center packing 7 for keeping watertight the gap between the outer peripheral surface of the flange portion 12 of the terminal fitting 2 is provided on the outer peripheral surface of the flange portion 12 of the terminal fitting 2. For this reason, it is possible to prevent ingress of a liquid such as water into the core wire 9 from the terminal end of the electric wire 8 without covering the terminal end of the electric wire 8 with a shrinkable tube. Therefore, it is possible to prevent an increase in the time and trouble involved in the assembly and prevent an increase in the manhour required for the assembly.

The above-described embodiment is only illustrative of a representative form of the invention, and the invention is not limited to the embodiment. Namely, the invention may be implemented in variously modified forms without departing from the spirit and scope of the invention.

INDUSTRIAL APPLICABILITY

According to the connector in accordance with the invention, it is prevented for the terminal fitting from easily moving inside the terminal accommodating chamber due to the shake of an automobile provided with the connector, for instance.

The invention claimed is:

1. A connector, comprising:

a terminal fitting which includes a wire connecting portion connected to an electric wire and an electric contact portion disposed coaxially with the wire connecting portion;

a connector housing which includes a fitting portion for fitting to a mating connector;

a rear holder which is fitted at an end portion of the connector housing on an opposite side of the fitting portion;

a terminal accommodating chamber which is provided in the connector housing, and which includes:

a first accommodating portion for accommodating the wire connecting portion;

a second accommodating portion which is continuous with the first accommodating portion to accommodate the electric contact portion and which is smaller in diameter than the first accommodating portion; and a stepped surface formed between the first and second accommodating portions;

a flange portion which projects from an outer peripheral surface of the wire connecting portion so as to contact the stepped surface; and a sleeve member provided between the flange portion and the rear holder so as to be accommodated in the first accommodating portion, wherein the sleeve member is formed into a cylindrical shape which is C-shaped in cross section.

2. The connector according to claim 1, further comprising:

a first packing provided between the sleeve member and the rear holder to keep watertight a gap between an outer peripheral surface of the electric wire and an inner surface of the first accommodating portion; and a second packing attached to an outer peripheral surface of the flange portion to keep watertight a gap between the outer peripheral surface of the flange portion and the inner surface of the first accommodating portion.

3. The connector according to claim 2, wherein the flange portion includes a recessed groove to accommodate the second packing.

4. The connector according to claim 2, wherein a longitudinal length of the first accommodating portion is the same as sum of the flange portion, the sleeve member and the first packing so that there is no gap between the stepped surface and the rear holder with respect to an inserting direction of the terminal fitting.

* * * * *